US010363717B2

(12) United States Patent
Greenfield

(10) Patent No.: US 10,363,717 B2
(45) **Date of Patent: *Jul. 30, 2019**

(54) METHODS, APPARATUS AND SYSTEMS FOR ESTABLISHING A REGISTERED SCORE, SLIT OR SLOT IN A CORRUGATED BOARD, AND ARTICLES PRODUCED THERE FROM

(71) Applicant: Scorrboard, LLC, Renton, WA (US)

(72) Inventor: Giles Greenfield, Renton, WA (US)

(73) Assignee: Scorrboard LLC, Renton, WA (US)

( * ) Notice: Subject to any disclaimer, the term of this patent is extended or adjusted under 35 U.S.C. 154(b) by 295 days.

This patent is subject to a terminal disclaimer.

(21) Appl. No.: 14/855,354

(22) Filed: Sep. 15, 2015

(65) Prior Publication Data

US 2016/0271897 A1 Sep. 22, 2016

Related U.S. Application Data

(63) Continuation of application No. PCT/US2014/030916, filed on Mar. 17, 2014.
(Continued)

(51) Int. Cl.

| | |
|---|---|
| ***B31F 1/08*** | (2006.01) |
| ***B31B 50/14*** | (2017.01) |
| ***B31B 50/25*** | (2017.01) |

(52) U.S. Cl.
CPC ..... *B31B 50/25* (2017.08); *B31F 1/08* (2013.01); *B31B 50/14* (2017.08)

(58) Field of Classification Search
CPC ..... B31F 1/08; B31B 50/14; B31B 50/25
(Continued)

(56) References Cited

U.S. PATENT DOCUMENTS

| | | | |
|---|---|---|---|
| 762,033 | A | 6/1904 | Ferres |
| 1,504,218 | A | 8/1924 | Crowell |

(Continued)

FOREIGN PATENT DOCUMENTS

| | | |
|---|---|---|
| AU | 2014232272 | 10/2015 |
| AU | 2014265869 | 10/2015 |

(Continued)

OTHER PUBLICATIONS

Extended European Search report and Written Opinion dated Oct. 31, 2017; European Patent Office No. 14797031.3; International Filing Date Mar. 17, 2014; pp. 1-8.

(Continued)

*Primary Examiner* — Hemant Desai
*Assistant Examiner* — Valentin Neacsu
(74) *Attorney, Agent, or Firm* — FisherBroyles LLP; Kevin D. Jablonski

(57) ABSTRACT

Methods, apparatus, and systems increase converting accuracy and consistency of corrugated articles of manufacture such as blanks, intermediates or converted structures to minimize unintended gap variations, fishtail variations and visual discord as well as to minimize unintentional loss of strength due to conversion of such articles. The constitution of converted articles formed from a corrugated board blanks according to the invention comprises at least one intelligently located score, slit or slot (hereinafter collectively "registered modification") based upon knowledge of the corrugated board's fluted medium, including the absolute relative location of at least one fluted medium feature and/or the fluted medium geometry, such as its pitch.

5 Claims, 1 Drawing Sheet

Related U.S. Application Data

(60) Provisional application No. 61/802,126, filed on Mar. 15, 2013.

(58) Field of Classification Search
USPC ..... 493/59, 60, 68, 79, 127
See application file for complete search history.

(56) References Cited

U.S. PATENT DOCUMENTS 1,582,841 A 4/1926 Lorenz
1,863,973 A 6/1932 Ellis, Jr.
2,054,867 A 9/1936 Rudin et al.
RE20,970 E 1/1939 Rowe et al.
2,359,314 A 10/1944 Klein et al.
2,474,391 A 6/1949 Bergstein
2,485,020 A * 10/1949 Staude ..... B31B 50/00 493/354
2,503,874 A 4/1950 Ives
2,651,448 A 8/1950 Dusseault
2,547,880 A 4/1951 Meyer et al.
2,960,145 A 11/1960 Ruegenberg
3,002,876 A 10/1961 Rosati
3,039,372 A * 6/1962 La Bombard ..... B31F 1/08 493/396
3,122,300 A * 2/1964 La Bombard ..... B65D 5/4266 229/100
3,156,599 A 11/1964 Keesee
3,178,494 A 4/1965 Tisdale
3,290,205 A 12/1966 Goldstein et al.
3,449,157 A 6/1969 Wandel
3,526,566 A * 9/1970 McIlvain John Gibson, Jr. ..... B31F 1/08 229/930
3,529,516 A 9/1970 Dorsey et al.
3,542,636 A 11/1970 Wandel
3,735,674 A * 5/1973 Haddock ..... B31B 50/00 493/354
3,773,587 A 11/1973 Flewwelling
4,034,135 A 7/1977 Passmore et al.
4,126,508 A 11/1978 Hoelzinger
4,179,253 A 12/1979 Lightfoot
4,268,555 A 5/1981 Kantz
4,285,764 A 8/1981 Salvai
4,437,850 A 3/1984 Ono
4,541,895 A 9/1985 Albert
4,618,391 A * 10/1986 Torti ..... B23D 36/0058 156/353
4,657,611 A 4/1987 Guins
4,693,413 A 9/1987 McFarland et al.
4,748,067 A 5/1988 Cline
4,800,286 A * 1/1989 Brears ..... G01B 11/026 250/227.11
4,800,826 A 1/1989 Shiskin
4,886,563 A 12/1989 Bennett et al.
4,931,346 A 6/1990 Nogueras Ardina
4,935,082 A 6/1990 Bennett et al.
5,356,364 A 10/1994 Veith et al.
5,419,796 A 5/1995 Miller
4,544,597 A 10/1995 Peer, Jr. et al.
5,508,083 A 4/1996 Chapman, Jr.
5,581,353 A * 12/1996 Taylor ..... B31F 1/2831 250/559.23
5,582,571 A 12/1996 Simpson et al.
5,589,257 A 12/1996 Carriker et al.
5,630,903 A 5/1997 Knorr et al.
5,687,517 A 11/1997 Wiercinski et al.
5,690,601 A * 11/1997 Cummings ..... B31F 1/0012 493/340
5,733,403 A 3/1998 Morley
5,799,861 A * 9/1998 Bonner ..... B32B 29/08 229/198.1
5,857,395 A * 1/1999 Bohm ..... B23D 35/008 493/227
6,056,840 A * 5/2000 Mills ..... B29C 53/063 156/217
6,139,938 A 10/2000 Lingle et al.
6,153,037 A 11/2000 Kim et al.
6,162,155 A 12/2000 Gordon et al.
6,508,751 B1 * 1/2003 Weishew ..... B31B 50/00 493/160
6,871,480 B1 3/2005 Goodrich
7,413,629 B2 8/2008 Fisher et al.
7,909,954 B2 * 3/2011 Johnston ..... B01D 25/001 156/195
7,963,899 B2 6/2011 Papsdorf et al.
8,012,309 B2 9/2011 Pare et al.
8,771,579 B2 7/2014 Kohler
2001/0001410 A1 5/2001 Ishibuchi et al.
2003/0137667 A1 * 7/2003 Reis ..... B31F 1/2831 356/429
2004/0076798 A1 4/2004 Larsson et al.
2004/0089412 A1 5/2004 Topolkaraev
2004/0159693 A1 * 8/2004 Adachi ..... B26D 5/02 225/3
2004/0224828 A1 11/2004 Nelles
2006/0151655 A1 * 7/2006 Johnston ..... B01D 25/001 242/410
2007/0098887 A1 5/2007 Kohler
2008/0300825 A1 12/2008 Ishibuchi et al.
2009/0029840 A1 1/2009 Chen
2010/0331160 A1 12/2010 Kohler
2011/0014433 A1 1/2011 Trani et al.
2011/0114712 A1 5/2011 Malo et al.
2011/0226847 A1 9/2011 Nakano
2012/0205429 A1 8/2012 Trani et al.
2012/0226250 A1 9/2012 Sato et al.
2014/0141113 A1 5/2014 Kohler
2014/0166520 A1 6/2014 Hoppe et al.
2015/0010734 A1 1/2015 Van Berlo
2015/0114249 A1 4/2015 Comorre
2015/0307755 A1 10/2015 Krumm et al.
2016/0167338 A1 6/2016 Greenfield
2016/0271897 A1 9/2016 Greenfield
2017/0157894 A9 6/2017 Greenfield
2017/0274616 A1 9/2017 Greenfield
2017/0282489 A1 10/2017 Greenfield
2017/0305103 A1 10/2017 Greenfield
2017/0341331 A1 * 11/2017 Greenfield ..... B31B 50/25

FOREIGN PATENT DOCUMENTS

CA 2907431 9/2014
CA 2907392 11/2014
CN 1126457 7/1996
CN 2841324 11/2006
CN 101952120 1/2011
CN 105121147 12/2015
CN 105121148 12/2015
EP 2969522 1/2016
EP 2969526 1/2016
FR 2550724 2/1985
FR 2594160 A3 8/1987
FR 2596033 9/1987
GB 594328 A 11/1947
GB 977069 A 12/1961
GB 2301316 12/1996
GB 2301316 A 12/1996
GB 2368074 A 4/2002
HK 1212298 6/2016
HK 1212302 6/2016
JP 02-235623 A 9/1990
JP 03-275292 A 12/1991
JP 1996-309889 A 11/1996
JP 2007152689 A 6/2007
JP 2011/079207 A 4/2011
JP 2011079207 A 4/2011
JP 2016-519008 6/2016
JP 2016515959 6/2016
KR 2000-0058870 10/2000
KR 2000/0058870 A 10/2000
KR 1008/66390 B1 11/2008

(56) References Cited

FOREIGN PATENT DOCUMENTS

| | | | |
|---|---|---|---|
| KR | 100866390 | B1 | 11/2008 |
| KR | 20160008170 | | 1/2016 |
| KR | 20160008518 | | 1/2016 |
| PH | 12015502380 | | 2/2016 |
| PH | 12015502381 | | 2/2016 |
| WO | 199535204 | A1 | 12/1995 |
| WO | 98/18614 | | 5/1998 |
| WO | 1999047347 | | 9/1999 |
| WO | 2009/101526 | A1 | 8/2009 |
| WO | 2012128604 | | 9/2012 |
| WO | WO 2013/098353 | A1 | 7/2013 |
| WO | 2014146036 | | 9/2014 |
| WO | 2014186043 | | 11/2014 |
| WO | WO 2015/128546 | A1 | 9/2015 |

OTHER PUBLICATIONS

First Examination Report for New Zealand Patent Application Serial No. 712616, New Zealand Intellectual Property Office, Nov. 30, 2015, pp. 2.
First Examination Report for New Zealand Patent Application Serial No. 712611, New Zealand Intellectual Property Office, Nov. 30, 2015, pp. 2.
International Search Report based on PCT/US2014/030916; Aug. 22, 2014, pp. 3.
International Search Report based on PCT/US2014/030909; Aug. 20, 2014, pp. 3.
First Patent Examination Report for Australian Patent Application Serial No. 2014232272, Australian Government, IP Australia, Mar. 3, 2016, pp. 3.
First Patent Examination Report for Australian Patent Application Serial No. 2014265869, Australian Government, IP Australia, Apr. 21, 2016, pp. 2.
Second Examination Report for New Zealand Patent Application Serial No. 712611, New Zealand Intellectual Property Office, Jul. 6, 2016, pp. 3.
Supplementary European Search Report for European application No. EP14762807, European Patent Office, The Hague, Jun. 21, 2016, pp. 5.
First Office Action and Search Report along with English Translation for Chinese Application No. 201480016009X, dated Aug. 3, 2016, pp. 17.
International Search Report & Written Opinion dated Jun. 15, 2017; PCT Appl. No. US17/23611 filed Mar. 22, 2017.
International Search Report & WrittenOpinion dated Jun. 27, 2017; PCT Appl. No. US17/25510; filed Mar. 31, 2017.
International Search Report & Written Opinion dated Jun. 30, 2017; PCT Appl. No. US17/027624; filed Apr. 14, 2017.
WO dated Aug. 20, 2009 for PCT/IB2009/000271 filed Feb. 13, 2009.
Internation Search Report & Written Opinion, dated Jul. 21, 2017; PCT/US2017/025531, filed Mar. 31, 2017.
International Search Report and Written Opinion dated Jul. 6, 2017; PCT Appl. US2017/25491, filed Mar. 31, 2017.

* cited by examiner

METHODS, APPARATUS AND SYSTEMS FOR ESTABLISHING A REGISTERED SCORE, SLIT OR SLOT IN A CORRUGATED BOARD, AND ARTICLES PRODUCED THERE FROM

PRIORITY CLAIM

The present application is a Continuation of International Patent Application Serial No. PCT/US2014/030916, entitled ESTABLISHING A REGISTERED SCORE, SLIT OR SLOT IN CORRUGATED BOARD, AND ARTICLES PRODUCED THEREFROM, filed Mar. 17, 2014; which claims the benefit of U.S. Provisional Patent Application Ser. No. 61/802,126, filed Mar. 15, 2013; all of the foregoing applications are incorporated herein by reference in their entireties.

BACKGROUND OF THE INVENTION

Heretofore, converting of corrugated boards or blanks into boxes, containers or other three-dimensional forms relied upon a design-conform paradigm wherein the locations of folds, creases, edges and corners for the converted blank were determined without consideration as to the effect on the corrugated board material (as persons skilled in the art well know, dimensional attributes such as caliper were necessarily taken into account). Thus, a container, for example, was designed in the abstract, e.g., corrugated board size, caliper, stiffness, etc., and a conforming blank was subjected to the converting process without consideration as to the effect that the converting process would have on the corrugated board. As a result, scores, slits and slots would be formed in the blank without meaningful concern over the consequences thereof. While such oversight has little consequences for a homogeneous material, the resulting folds, creases, corners or edges would often cause compromised outer liner integrity and/or crushed inner liner and fluted mediums in the converted article. This consequence not only decreased structural performance of the article, but significantly reduced the number of reuse cycles. Moreover, because the scores, for example, did not evenly affect the corrugated board, the folds, creases, corners or edges were often uneven, which resulted in unintended flap gaps, fishtails and the like, not to mention overall visual discord.

Conventional wisdom dictated that compromised outer liner integrity issues could be resolved by increasing the basis weight of the liner, modifying the geometry of the score, or adding localized reinforcements. However, increasing material strength not only increased costs associated with the blanks and increased transportation costs, but also increased inner liner and/or fluted medium negative outcomes. The converse was also true: minimizing issues with inner liner and/or fluted medium crushing and the like would have at best limited negative effect to the outer liner issues.

BRIEF DESCRIPTION OF DRAWINGS

Aspects of many of the attendant advantages of the claims will become more readily appreciated as the same become better understood by reference to the following detailed description, when taken in conjunction with the accompanying drawings, wherein:

SUMMARY OF THE INVENTION

Figure 1:
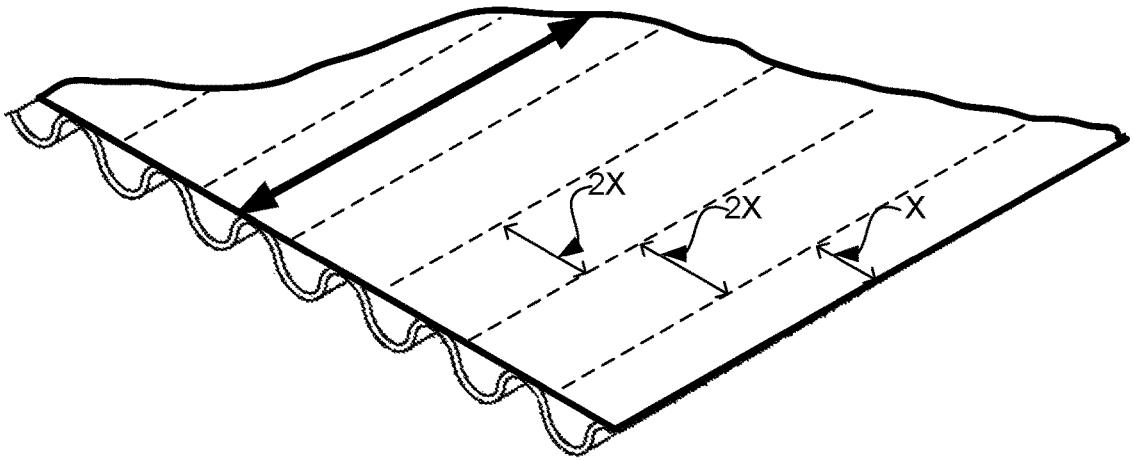
FIG. 1 is a diagram of a portion of resultant corrugated paper product that includes a liner portions and a fluted portion with incongruent major axes according to an embodiment of the subject matter disclosed herein.
Figure 2:
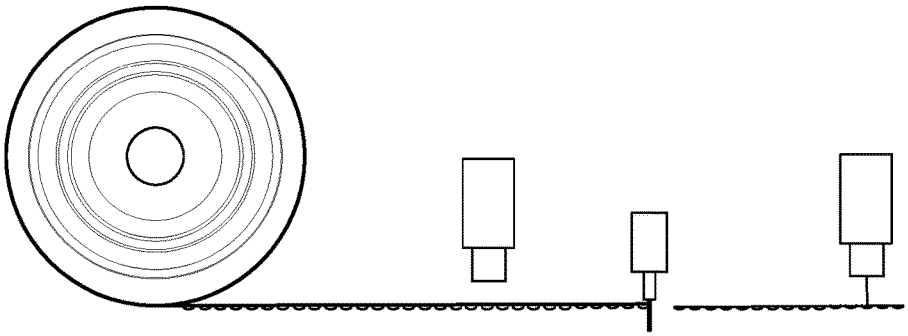
FIG. 2 shows an embodiment of a machine for producing the paper product of FIG. 1 according to an embodiment of the subject matter disclosed herein.

The invention is directed to methods, apparatus, and systems for increasing converting accuracy and consistency of corrugated articles of manufacture such as blanks, intermediates or converted structures to minimize unintended gap variations, fishtail variations and visual discord as well as to minimize unintentional loss of strength due to conversion of such articles. The constitution of converted articles formed from a corrugated board blanks according to the invention comprises at least one intelligently located score, slit or slot (hereinafter collectively "registered modification") based upon knowledge of the corrugated board's fluted medium, including the absolute relative location of at least one fluted medium feature and/or the fluted medium geometry, such as its pitch.

In view of the foregoing, methods according to the invention comprise establishing a registered modification using a fluted medium of a corrugated board wherein the registered modification is substantially at a constant distance from a fluted medium feature, such as a peak or a valley, in a direction orthogonal to the flute axis. In this sense, the modification is said to be in registration with the fluted medium and is referred to herein as a registered modification. It should be understood that the desired registration information can be obtained in many ways including, but not limited to, spatial location knowledge of at least one fluted medium feature and the fluted medium's pitch quality (e.g., frequency and whether constant or variable); or sufficient spatial location knowledge of a plurality of fluted medium features to enable creation of a registered modification. Using either methodology and in addition to/in lieu of creation of a registered modification, at least one visual and/or machine discernible registration indicia can be established on the corrugated board to aid in the creation of future registered modifications.

Apparatus and systems according to the invention enable determination of the registration information in one respect, and formation of the registered modification in another respect. In the first respect, registration information of a corrugated board can be obtained, for example, from engineering/manufacturing data about the board and/or inspection of the board (e.g., optical, sonic, thermal, etc.). In the second respect, formation of the registered modification can be accomplished, for example, by CAM/CNC machinery using information obtained in the first respect, or by creation of a registered edge in a corrugated board from which subsequent measurements or determinations for modification locations are made. As used herein, a registered edge is one that is substantially at a constant displacement from a fluted medium feature, such as a peak or a valley, either of which runs parallel to the flute axis. In this sense, the edge is said to be in registration with the fluted medium and corrugated board possessing a registered edge can be described as edge registered. Once a registered edge has been established, registered modifications can be made to the board simply based upon knowledge of the fluted medium's pitch quality.

The invention is further directed to articles resulting from practice of the methods and/or use of the apparatus or systems herein described. In a first series of embodiments, such articles may be characterized as edge registered single or multiple wall corrugated board, edge registered single or multiple wall corrugated board blanks or such blanks that have been converted to a finished form. To fall within the scope of this invention series, it is not necessary that such articles also have at least one registered modification formed therein; it is only necessary that at least one edge of the article be a registered edge as that term is used herein.

Further detailing each of the invention classes, a first series of method embodiments of the invention comprises establishing a registered edge in a corrugated board prior to creating any modification of the same. By establishing a registered edge, which is preferably parallel to the flute direction (alternatively characterized as perpendicular to the presumptive weak axis of the corrugated board), any constant distance there from along the registered edge, and in multiples of the fluted medium's pitch (i.e., period), will encounter substantially consistent mechanical properties of the corrugated board, particularly with respect to the fluted medium. In other words, if the distance from the registered edge to a flute valley in one direction is "x", the same distance "x" in the same direction anywhere along the registered edge will also terminate along the same flute valley.

The registered edge can be established by ascertaining the run length location of a fluted medium feature, for example a most lateral continuous valley, and cross cutting the corrugated board along this fluted medium feature. Since significant fluted medium run-out along the flute axis is rarely encountered in current corrugating production, the resulting edges will form the trailing edge of one corrugated board sheet and the leading edge of another. Furthermore, because there is no meaningful kerf to the cross cutting action, registry among sheets is maintained.

To ascertain the location of a fluted medium feature, a variety of inspection means can be used, which include, but are not limited to, optical emitters and sensors, which detect changes in transmitted or back-scattered light to characterize the corrugated board; sonic transducers, which detect changes in material density and/or caliper of the corrugated board; and thermal emitters and sensors, which detect changes in transmitted or back-scattered heat signatures to characterize the corrugated board. Those persons skilled in the art will realize that alternative modes for detection can be used that rely upon the principles of the foregoing examples, such as millimeter wave technologies, moisture sensors, and the like.

Once the data regarding the relative location of the feature of interest has been acquired, the data can be exploited to guide a trimming tool and/or stage upon which the corrugated board is placed in order to effectuate the desired trimming actions. When completed, a flute-based registered edge will have been established.

By establishing a registered edge, a registered modification can be established through knowledge of the corrugated board's fluted medium pitch or frequency, and its quality. Presuming a constant pitch quality, the weak axis direction material constitution can be ascertained by using multiples of the fluted medium's period based from the registered edge. For example, if the fluted medium is a "C" type and has a pitch "P' of 7.6 mm (e.g., a peak to peak distance) and if the registered edge corresponds to a flute valley, then "n" multiples of 7.6 mm (n×P) as measured from the registered edge will necessarily correspond to a flute valley, which may be a desired location to establish a score. Because the registered edge preferably forms the baseline for all further material modifications, no further examination of the corrugated board is needed.

In a second series of method embodiments, the invention comprises establishing a registered modification in a corrugated board not based upon a registered edge, but based upon the absolute relative location(s) of the fluted medium features. An advantage of a blank having a registered edge, for example, is that no further evaluation of the corrugated board is necessary nor is any additional specialized equipment needed to form a registered modification. However, under certain circumstances it may be desirable to simply locate registered modifications in non-edge registered articles. In such situations, the previously described inspection means can determine the spatial geometry of a fluted medium of a corrugated board where after desired modifications can be made to the board that result in registered modifications.

While a wide variety of apparatus and systems are available for carrying out the methods described herein, an exemplary system for creating a registered edge and a registered modification in the form of a score will now be described. Corrugated sheets are created from a continuous web of combined corrugated board, where a cross cutting knife (cut-off knife) severs the web in register to a predetermined and repeatable point in a single flute. This cut-off operates continuously to cut sheets that are always multiples of a single flute pitch. Therefore, if the knife cuts precisely in the flute valley center, and the sheets are always accurate multiples of the flute pitch. The board is produced with the running direction at 90 degrees to the flute direction. Each successive sheet is the same as the preceding one. When any such sheet is introduced into a converting machine, it is placed relative to a front or side stop (depending on the direction it is to travel through the converting process), whereby the position of each and every flute valley is known relative to its edge(s).

In designing a box or container that the corrugated board is to be converted into, scores, slits, slots, and the like that run parallel to the flutes are positioned accurately to be in register with the flutes. Boxes/containers have scores (for instance) always positioned in the same place relative to the flute individual profile, which will have the effect of producing the same desirable folding effect and accuracy. Score-to-score design panel dimensions will always be multiples of the individual flute pitch employed when making the corrugated board/sheet itself. By using the valley of an individual flute, as viewed from the inside surface of the sheet being employed in making of the box, for example, the folding process collapses the inner liner into the flute valley without crushing the flutes themselves, thereby preserving the essential strength of the corrugated board and making a stronger corner to the container than has been previously possible when non-registering to the flute line/valley (the "in-folded" liner functionally creates an arch or second flute in addition to occupying the flute valley, thereby providing dual means for enhancing corner strength). Registering these parallel-to-flute-valley converting considerations also enhances the repeatable assembled accuracy and appearance of finished containers, also an attribute missing when non-registered conversion operations are carried out.

Because of the high level of in-folding precision achieved when establishing scored corners in corrugated boards, it is both possible and desirable to create pseudo-radiused corners or folds. Pseudo-radiused corners are corner pairs or triplets that permit adjacent or proximately located corners or folds to mimic high degree corners or folds, that otherwise may compromise the structural integrity of the resulting converted article. As used herein, "proximately located" corners or folds are in-folds that are low pitch multiples from each other, e.g., 1, 2 or 3 flute periods or specifically, valleys. For example, a pair of adjacent or proximately located 45° corners or folds mimic a 90° corner; a triplet of 30° folds also mimic a 90° corner. Through the use of registered scores that necessarily limit in-folds to flute valleys, for example, it is possible to have adjacent or proximate located folds that increase the load handling capability of the converted article as opposed to decrease it as would be the case using prior art methods.

The invention and its embodiments also provide opportunities for enhancing the performance of multiple wall corrugated board: by creating multiple wall corrugated board wherein the fluted mediums are registered with each other (such as when similar pitch mediums are used) or choosing pitch multiples that registration still occurs even when differing pitches are used, the benefits of the invention such as increased accuracy and consistency as well as minimized loss of strength during conversion processes can be achieved.

Finally, articles within the scope of the invention set forth herein include at least one registered edge or at least one registered modification resulting from the practice of at least one method aspect of the present invention. Articles may, and desirable do, comprise both at least one registered edge and one registered modification. As noted previously, articles comprise single or multiple wall corrugated board, corrugated board blanks and/or converted corrugated boards such as containers, boxes, displays, or any other three-dimensional corrugated structure resulting from a converting process.

What is claimed:

1. A method for creating a registered modification in corrugated board, the method comprising:

ascertaining locations of first and second features of a fluted medium in the corrugated board, the fluted medium having a plurality of flutes, each flute having a flute peak, a flute axis, and a flute pitch, wherein the first feature comprises a flute feature on a first one of the plurality of flutes and the second feature comprises a flute feature on a second one of the plurality of flutes;

determining a distance from the first and second features in a direction orthogonal to the flute axis for establishing a location of a first registered modification; and creating the first registered modification at the established location without penetrating the corrugated board;

determining a distance from the first registered modification in the direction orthogonal to the flute axis for establishing a second location of a second registered modification; and creating the second registered modification at the second established location without penetrating the corrugated board;

wherein the flute pitch is used to establish the second established location in combination with the location of the first registered modification.

2. The method of claim 1 wherein the first registered modification is linear and parallel with the flute axis.

3. The method of claim 1 wherein the flute feature comprises a flute valley.

4. The method of claim 3 wherein the first registered modification forms a corner of a corrugated container.

5. The method of claim 1 wherein the flute feature comprises a flute peak.

* * * * *